US011152697B2

(12) United States Patent
Villa

(10) Patent No.: US 11,152,697 B2
(45) Date of Patent: Oct. 19, 2021

(54) DUAL BROADBAND ANTENNA SYSTEM FOR VEHICLES

(71) Applicant: Advanced Automotive Antennas, S.L.U., Barcelona (ES)

(72) Inventor: Marc Imbert Villa, Barcelona (ES)

(73) Assignee: ADVANCED AUTOMOTIVE ANTENNAS, S.L.U., Barcelona (ES)

( * ) Notice: Subject to any disclaimer, the term of this patent is extended or adjusted under 35 U.S.C. 154(b) by 146 days.

(21) Appl. No.: 16/441,774

(22) Filed: Jun. 14, 2019

(65) Prior Publication Data

US 2019/0386384 A1 Dec. 19, 2019

(30) Foreign Application Priority Data

Jun. 15, 2018 (EP) ..... 18382429

(51) Int. Cl.

| | |
|---|---|
| ***H01Q 1/52*** | (2006.01) |
| ***H01Q 9/42*** | (2006.01) |
| ***H01Q 5/371*** | (2015.01) |
| ***H01Q 21/28*** | (2006.01) |
| ***H01Q 1/36*** | (2006.01) |
| ***H01Q 9/40*** | (2006.01) |
| ***H01Q 1/32*** | (2006.01) |

(52) U.S. Cl.

CPC ..... *H01Q 1/521* (2013.01); *H01Q 1/36* (2013.01); *H01Q 5/371* (2015.01); *H01Q 9/40* (2013.01); *H01Q 9/42* (2013.01); *H01Q 21/28* (2013.01); *H01Q 1/32* (2013.01)

(58) Field of Classification Search

CPC ..... H01Q 1/32; H01Q 1/3208; H01Q 1/325; H01Q 1/3275; H01Q 1/52; H01Q 1/521; H01Q 1/523; H01Q 1/36; H01Q 1/48; H01Q 5/25; H01Q 5/30; H01Q 5/371; H01Q 9/0414; H01Q 9/30; H01Q 9/32; H01Q 9/36; H01Q 9/38; H01Q 9/40; H01Q 9/42; H01Q 9/44; H01Q 9/46; H01Q 21/24; H01Q 21/28

See application file for complete search history.

(56) References Cited

U.S. PATENT DOCUMENTS

2006/0044196 A1* 3/2006 Grant ..... H01Q 1/3291 343/713
2013/0229318 A1* 9/2013 Ng ..... H01Q 5/30 343/770

OTHER PUBLICATIONS

R. Parolari et al., "A novel 3D antenna for LTE MIMO systems," 2017 International Conference of Electrical and Electronic Technologies for Automotive, Torino, 2017, pp. 1-4, doi: 10.23919/EETA.2017.7993228.*

* cited by examiner

*Primary Examiner* — Robert Karacsony
(74) *Attorney, Agent, or Firm* — Cantor Colburn LLP

(57) ABSTRACT

A dual broadband and multiband antenna system of reduced dimension may be used as external antenna for vehicles. The antenna system includes first and second radiating elements and a flat ground plane in common with the two radiating elements. The two radiating elements are placed above an upper surface of the ground plane, and each radiating element is folded and has a vertical and horizontal surface. The vertical surfaces of the two radiating elements are substantially orthogonal to the ground plane and substantially parallel to each other. The horizontal surfaces of the two radiating elements are substantially coplanar and substantially parallel to the ground plane. The antenna system is preferably adapted to operate on the LTE communication network and provides 5G communication services.

8 Claims, 9 Drawing Sheets

| Rad Ele 1 | 700MHz | | | 800MHz | | | 1,5GHz | | | 1,8GHz | | | 2,0GHz | | | 2,3GHz | | | 2,5GHz | | | 3,5GHz | | | 4,5GHz | | | 5,9GHz | | |
|---|---|---|---|---|---|---|---|---|---|---|---|---|---|---|---|---|---|---|---|---|---|---|---|---|---|---|---|---|---|---|
| Freq (MHz) | 700 | 748 | 798 | 803 | 880 | 960 | 1428 | 1463 | 1511 | 1710 | 1785 | 1880 | 1910 | 2110 | 2200 | 2305 | 2350 | 2360 | 2496 | 2570 | 2690 | 3300 | 3600 | 3800 | 4200 | 4400 | 5000 | 5855 | 5890 | 5925 |
| VSWR (1) | 3.3 | 2.6 | 2.9 | 2.8 | 2.5 | 2.2 | 2.0 | 1.5 | 1.7 | 2.1 | 2.7 | 2.2 | 2.6 | 2.7 | 3.3 | 2.7 | 3.3 | 3.4 | 2.7 | 3.0 | 1.9 | 1.4 | 1.4 | 1.5 | 1.1 | 1.3 | 2.0 | 1.8 | 1.8 | 1.9 |

| Rad Ele 2 | 700MHz | | | 800MHz | | | 1,5GHz | | | 1,8GHz | | | 2,0GHz | | | 2,3GHz | | | 2,5GHz | | | 3,5GHz | | | 4,5GHz | | | 5,9GHz | | |
|---|---|---|---|---|---|---|---|---|---|---|---|---|---|---|---|---|---|---|---|---|---|---|---|---|---|---|---|---|---|---|
| Freq (MHz) | 700 | 748 | 798 | 803 | 880 | 960 | 1428 | 1463 | 1511 | 1710 | 1785 | 1880 | 1910 | 2110 | 2200 | 2305 | 2350 | 2360 | 2496 | 2570 | 2690 | 3300 | 3600 | 3800 | 4200 | 4400 | 5000 | 5855 | 5890 | 5925 |
| VSWR (2) | 2.9 | 2.1 | 1.9 | 1.9 | 1.9 | 2.3 | 3.0 | 2.5 | 2.3 | 2.4 | 2.7 | 2.6 | 2.8 | 3.5 | 3.6 | 3.[illegible] | 2.8 | 2.7 | 2.4 | 2.3 | 1.8 | 1.7 | 2.0 | 2.2 | 2.1 | 2.1 | 1.6 | 2.1 | 2.0 | 1.8 |

Small Fine tunning Ongoing

FIG. 7

| Rad Ele 1 | 700MHz | | 800MHz | | 1.5GHz | | 1.8GHz | | 2.0GHz | | 2.3GHz | | 2.5GHz | | 3.5GHz | | 4.5GHz | | 5.9GHz | |
|---|---|---|---|---|---|---|---|---|---|---|---|---|---|---|---|---|---|---|---|---|
| Freq (MHz) | 700 | 798 | 803 | 960 | 1428 | 1511 | 1710 | 1880 | 1910 | 2200 | 2305 | 2360 | 2496 | 2690 | 3300 | 3800 | 4200 | 5000 | 5855 | 5925 |
| LAG (dBi) | -6.3 | -5.2 | -5.2 | -6.7 | -2.3 | -1.5 | -1.5 | -1.7 | -1.7 | -1.4 | -1.6 | -1.7 | -2.8 | -1.6 | -0.6 | -0.6 | -0.5 | -1.0 | -1.2 | -1.4 |

| Rad Ele 2 | 700MHz | | 800MHz | | 1.5GHz | | 1.8GHz | | 2.0GHz | | 2.3GHz | | 2.5GHz | | 3.5GHz | | 4.5GHz | | 5.9GHz | |
|---|---|---|---|---|---|---|---|---|---|---|---|---|---|---|---|---|---|---|---|---|
| Freq (MHz) | 700 | 798 | 803 | 960 | 1428 | 1511 | 1710 | 1880 | 1910 | 2200 | 2305 | 2360 | 2496 | 2690 | 3300 | 3800 | 4200 | 5000 | 5855 | 5925 |
| LAG (dBi) | -6.4 | -5.0 | -5.1 | -6.7 | -2.3 | -1.6 | -1.4 | -1.6 | -1.7 | -1.5 | -1.8 | -1.8 | -3.1 | -1.6 | -0.7 | -0.8 | -0.7 | -1.4 | -1.1 | -1.2 |

FIG. 10

| Rad Ele 1 | 700MHz | | 800MHz | | 1.5GHz | | 1.8GHz | | 2.0GHz | | 2.3GHz | | 2.5GHz | | 3.5GHz | | 4.5GHz | |
|---|---|---|---|---|---|---|---|---|---|---|---|---|---|---|---|---|---|---|
| Freq (MHz) | 729 | 768 | 803 | 960 | 1475 | 1511 | 1805 | 1880 | 1930 | 2200 | 2350 | 2360 | 2496 | 2690 | 3300 | 3600 | 4200 | 5000 |
| ECC | 0.429 | 0.189 | 0.09 | 0.185 | 0.01 | 0.001 | 0.04 | 0.06 | 0.05 | 0.001 | 0.01 | 0.001 | 0.007 | 0.05 | 0.01 | 0.002 | 0.008 | 0.001 |

DUAL BROADBAND ANTENNA SYSTEM FOR VEHICLES

CROSS-REFERENCES TO RELATED APPLICATIONS

This patent application claims priority to European Provisional Patent Application No. 18382429.1, filed Jun. 15, 2018, which is incorporated herein by reference in its entirety.

INTRODUCTION

The present disclosure relate to broadband and multiband antennas, and more particularly to broadband and multiband antennas as remote or external antennas for vehicles.

Due to the large size of some electronic devices, it is difficult to accommodate a large antenna system inside a reduced space. For this reason, many communication devices of motor vehicles require remote (external) antennas to increase the performance of an internal antenna. In that scenario, it is critical that the dimension of the external antenna be as small as possible to facilitate fitting inside a reduced space within a vehicle.

SUMMARY

An object of the present disclosure is to provide a broadband, multiband and high efficiency antenna system of reduced dimensions that can be fitted within a confined space, for example inside a component of a vehicle.

The antenna system of the present disclosure is preferably adapted to operate on the LTE communication network, and to provide 5G communication services.

Another advantage of the external antenna, in contrast to internal antennas, is its performance in terms of electronic noise. Internal antennas should obtain worst sensitivity of the whole system as being nearer of the electronic noise sources (clocks, microprocessors, etc.). Therefore, in case of the external antennas this situation is improved as they can be moved out from these noise sources.

For example, LTE antennas require at the same time both a main antenna and a diversity antenna. However, these two LTE antennas (main and diversity) cannot be accommodated in the narrow interior of a shark fin antenna, especially in the low frequency band (700 MHz-1 GHz), wherein signal interference is high, and the level of the un-correlation obtained between the antennas would be poor. When more than one antenna is needed on a mobile system as LIE, antennas must be as uncorrelated as possible between them.

On the other hand, in latest cellular technologies, the number of telephony antennas that must be included in the car has increased, as well as the requested performance. For LTE systems, typically 2 antennas are used. For the last evolutions of LTE and for the upcoming 5G antenna, the number of antennas will increase, requiring at least 4 Telephony antennas in the vehicles.

However, vehicles styling is more important every day, and therefore antennas must be hidden and cannot impact on vehicle external design, therefore the available space for antennas is reduced.

In that scenario, it is also critical to be able to integrate 2 antennas in a single box with reduced space in order to have antenna modules (with 2 antennas in each module) reducing the number of antenna modules that the vehicle manufactured need to install in a vehicle in the production line Furthermore, it is a challenge to integrate a multiband, highly efficient, low VSWR LTE antenna in this reduced dimension.

Therefore, it is desirable to develop an improved antenna system for a vehicle that having a reduced size, offers a high efficiency and a broadband behavior. It would be also desirable that the improved antenna system operates on all LTE frequency bands without losing its broadband and highly efficient characteristics in any band.

The antenna system is defined in the attached independent claim, and it refers to an antenna topology that fulfills the above-described challenges of the prior art, by providing an antenna topology comprising two radiating elements sharing a common ground plane that features a broad bandwidth and high efficiency, that can be fitted inside a reduced space.

An aspect of the antenna system refers to a dual broadband antenna system for vehicles, wherein the antenna system comprises two radiating elements placed above an upper surface of a common ground plane for the two radiating elements.

Each radiating element is folded to form a vertical and a horizontal surface, such as the vertical surface of the two radiating elements are substantially orthogonal to the ground plane and substantially parallel to each other. The horizontal surfaces of the two radiating elements are substantially coplanar and substantially parallel to the ground plane.

The antenna system further comprises two feeding ports respectively connected between the radiating elements and the ground plane.

Preferably, the ground plane is rectangular and has two opposing large sides and two opposing short sides, and wherein the vertical surfaces of the first and second radiating elements project from opposite large sides of the ground plane. In turn, each of the first and second radiating elements is closer to opposite sides of the ground plane.

In a preferred embodiment, the shape of the vertical surfaces of the radiating elements comprises a part of an ellipse curve, and similarly the horizontal surfaces of the radiating elements comprise a part of an ellipse curve. The effect of having two radiating elements placed over a common ground plane, is that the bandwidth of the overall antenna system, is increased.

The technical effect of the elliptical shape of the vertical surfaces of the radiating elements, is that the antenna system features a broadband behavior ranging from 700 MHz-5G.

Preferably, the first and second radiating elements further comprise first and second arms respectively extending from the vertical surface, each arm having a first substantially horizontal segment parallel to the ground plane. In other embodiments of the antenna system and for fine tuning, the radiating elements further comprises a horizontal segment, extending from the first segment, parallel to the vertical surface and coplanar with the vertical surface of the other radiating element.

The antenna system of the present disclosure is preferably adapted to operate at least within one Long Term Evolution (LTE) frequency band, and to be used as remote antenna for a motor vehicle, and to provide 5G communication services.

Some of the advantages of the present antenna system are summarized below:

- Dual LTE antenna;
- No need for a ground connection to the vehicle, the antenna is itself grounded;
- Multiband behavior;
- High efficiency performance;

Compatible to integrate a satellite navigation antenna (GNSS); including an amplifier splitter to be able to use the GNSS signal in several ECU's; and Compact geometry, maximum dimensions around λ/5×λ/13λ/20 thus, it can be integrated within a confined space.

The above features and advantages, and other features and advantages of the disclosure are readily apparent from the following detailed description when taken in connection with the accompanying drawings.

BRIEF DESCRIPTION OF THE DRAWINGS

Other features, advantages and details appear, by way of example only, in the following detailed description, the detailed description referring to the drawings in which:

FIG. 7 shows a graph comparing the radiating elements matching.

FIG. 10 shows a graph Total Linear Average Gain (LAG) for the second radiating element.

DETAILED DESCRIPTION

Figure 1:
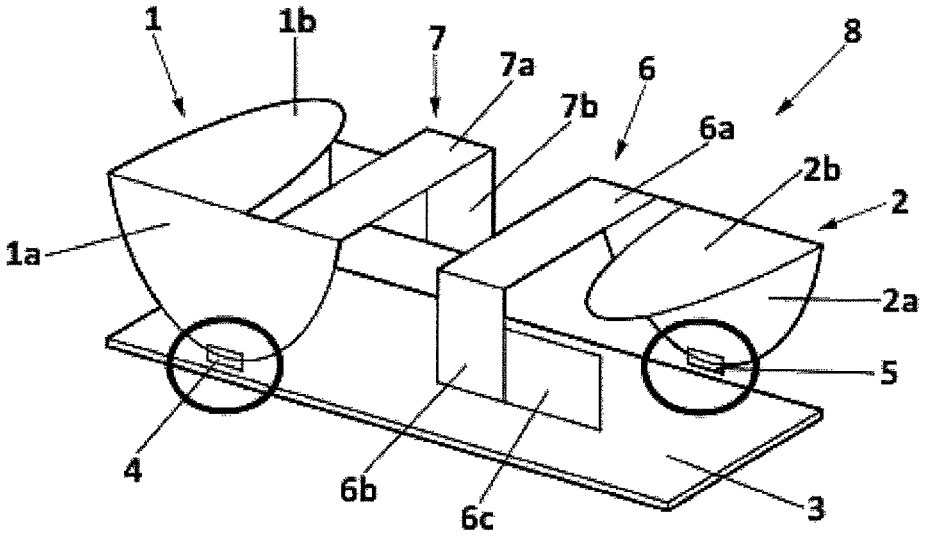
FIG. 1 shows a perspective view from above of a preferred embodiment of an antenna system according to one, non-limiting, exemplary embodiment of the invention.

The following description is merely exemplary in nature and is not intended to limit the present disclosure, its application or uses. It should be understood that throughout the drawings, corresponding reference numerals indicate like or corresponding parts and features.

Figure 2:
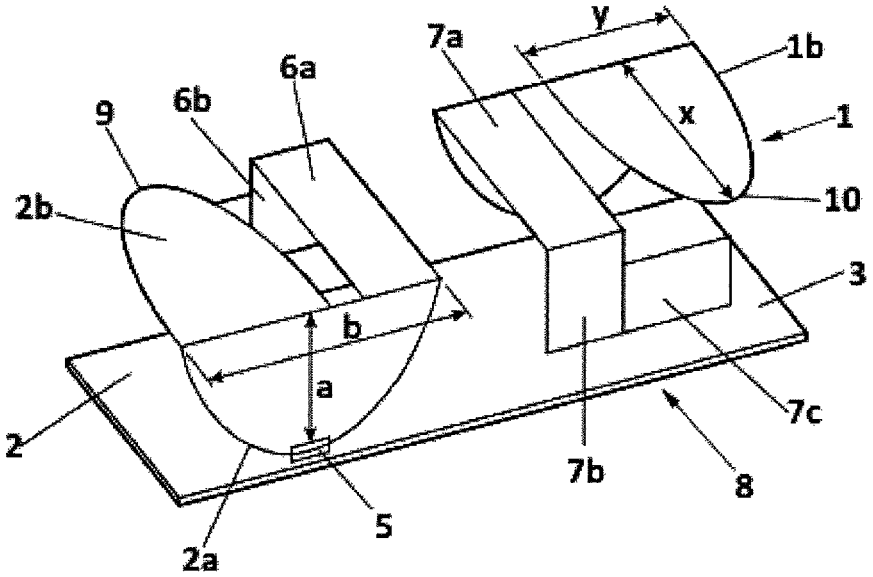
FIG. 2 shows another perspective view of the preferred embodiment of FIG. 1.

FIGS. 1 and 2 show a preferred embodiment of the antenna system of the invention 8, that comprises first and second radiating elements 1, 2 and a flat ground plane 3 in common for the two radiating elements 1, 2. The two radiating elements 1, 2 are placed above an upper face of the ground plane 3, and two feeding ports 4, 5 of the antenna system, are respectively connected between the radiating elements 1, 2 and the ground plane 3, thus, the radiating elements are not directly connected with the ground plane 3.

Each radiating element 1, 2 is folded such as it has a vertical surface 1*a*, 2*a* and a horizontal surface 1*b*, 2*b*, and wherein the vertical surfaces 1*a*, 2*a* of the two radiating elements 1, 2 are orthogonal to the ground plane 3 and parallel to each other. Additionally, the horizontal surfaces 1*b*, 2*b* of the two radiating elements 1, 2 are coplanar between them, and parallel to the ground plane 3.

The ground plane 3 is generally rectangular and as such, it has two opposing large sides and two opposing short sides, and the vertical surfaces 1*a*, 2*a* of the first and second radiating elements 1, 2 projects from opposite large sides of the ground plane 3. Furthermore, each of the first and second radiating elements 1, 2 is closer to opposite short sides of the ground plane 3.

With the above-described arrangement of components, the antenna system 8 generally configures a rectangular prismatic volume which larger side is around 82 mm. In this way, the antenna system can be enclosed in a housing (not shown), with maximum dimensions of 82×32×22 mm.

Taking in account that the lowest frequency of operation is at 700 MHz and the velocity of wave propagation over the air (v=3e8 m/s) the operative wavelength is (λ=v/f=3e8/700e6=428 mm). As described on FIG. 4 in terms of wavelength the larger 82 mm side is a ratio of λ/5 and the shorter side of 32 mm as a ratio of λ/13. For the rest of the antenna structure dimensions can be related with the defined operative wavelength value. In this way, the antenna system can be enclosed in a housing (not shown), with maximum dimensions of λ/5×λ/13×λ/20.

Figure 3:
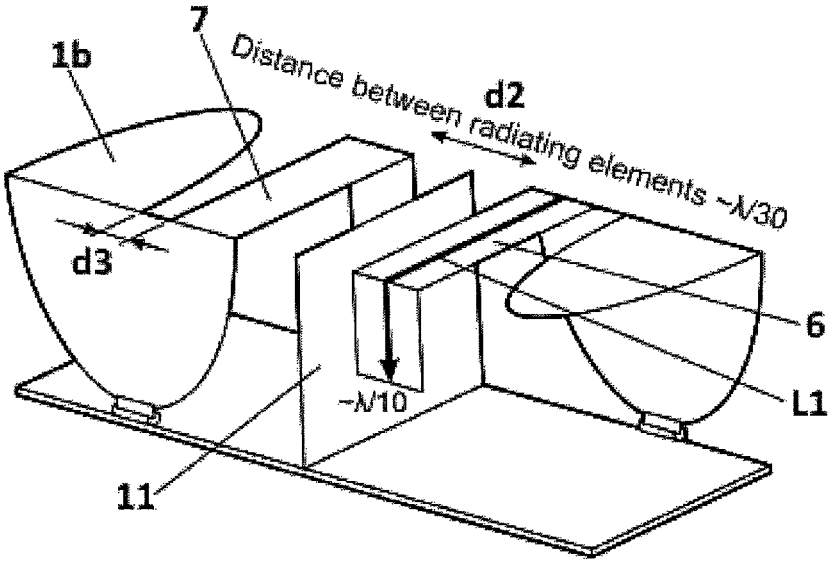
FIG. 3 shows another perspective view of the preferred embodiment of FIG. 1 including a decoupling element.
Figure 4:
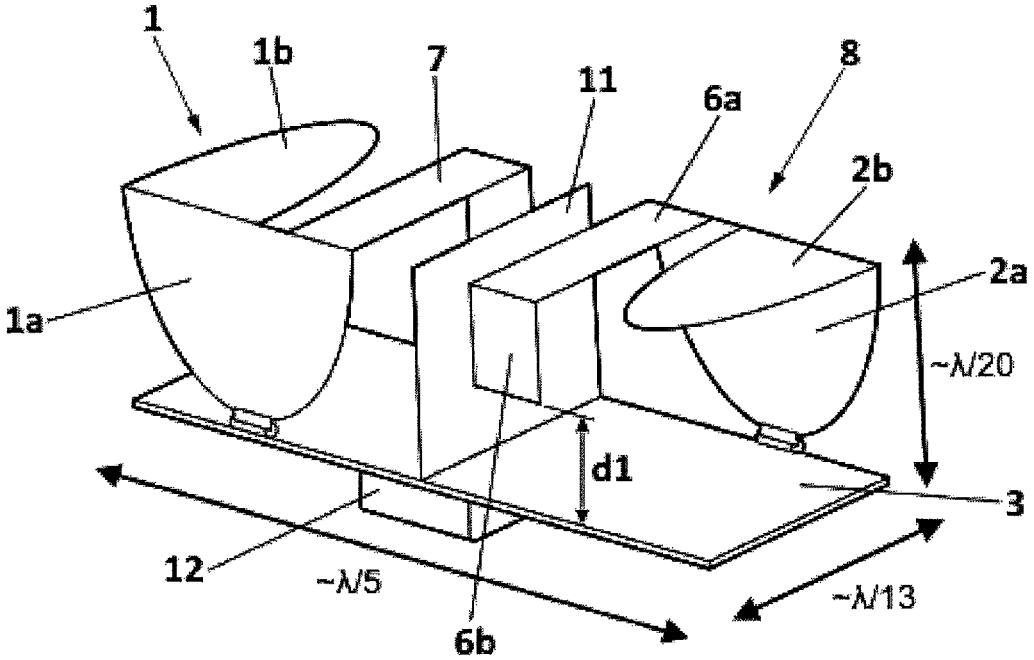
FIG. 4 shows another perspective view of the preferred embodiment of FIG. 3 including a GNSS antenna.
Figure 5:
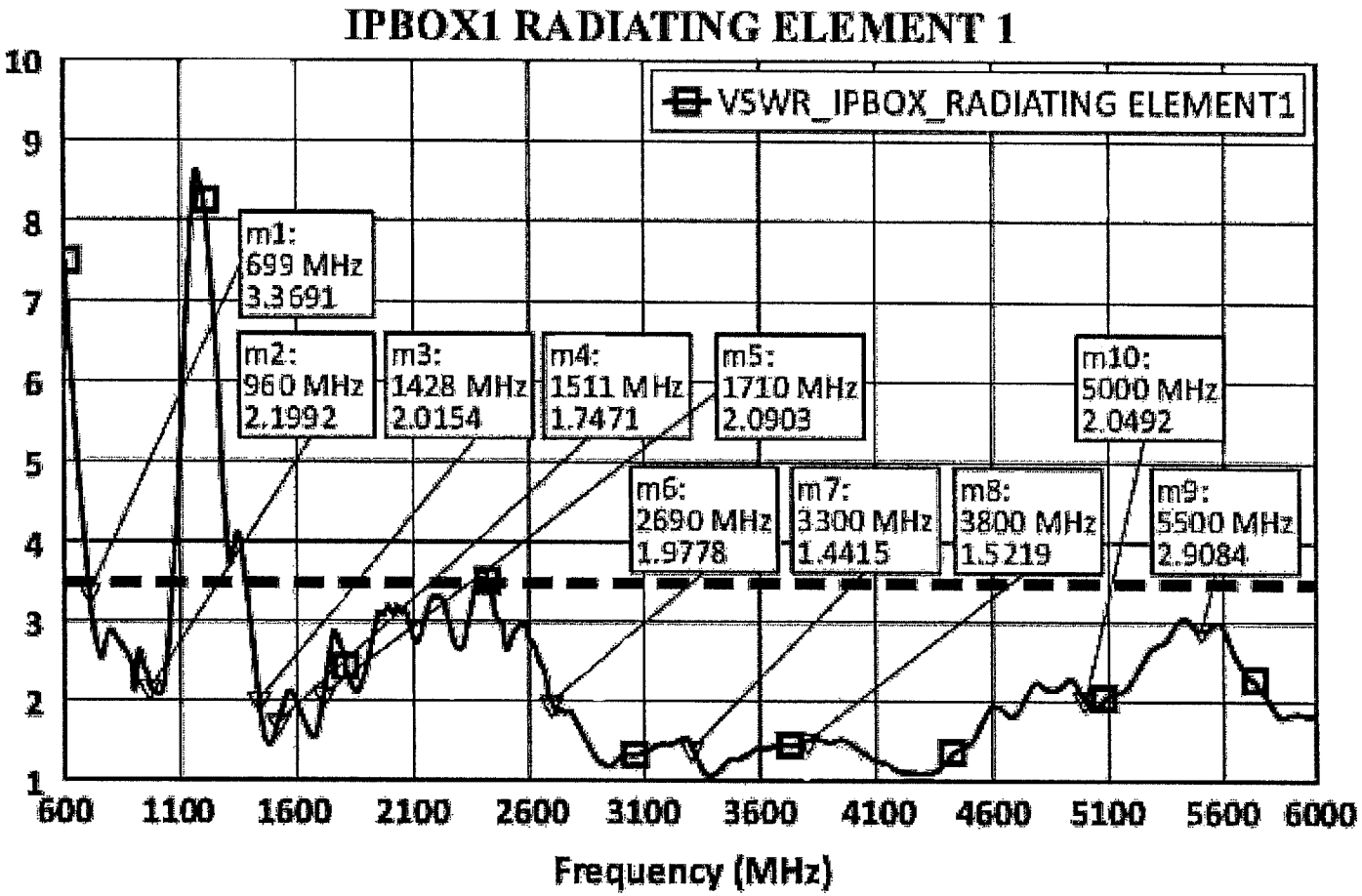
FIG. 5. shows a graph corresponding to matching of the first radiating element.
Figure 6:
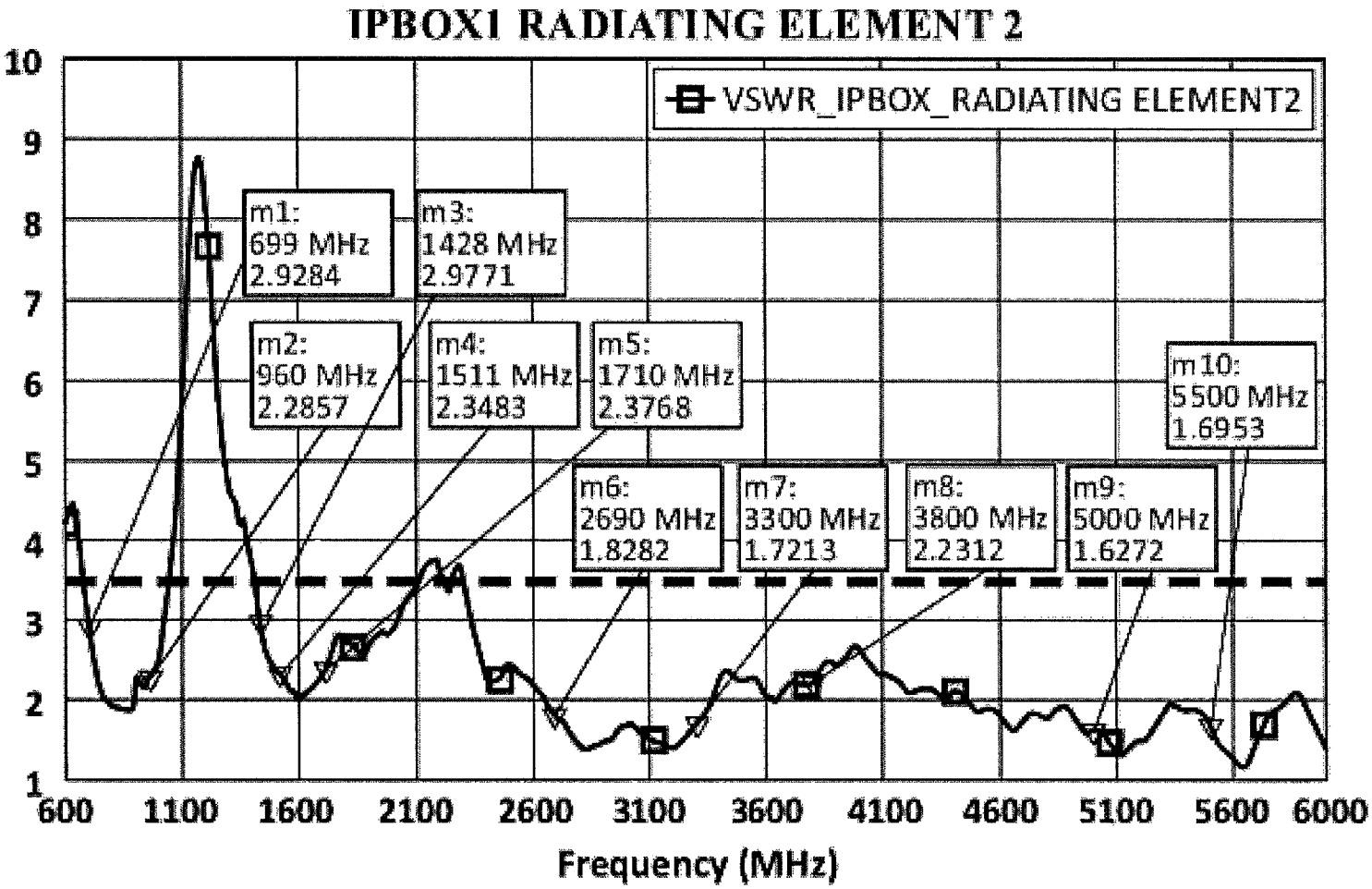
FIG. 6 shows a graph corresponding to matching of the second radiating element.
Figure 8:
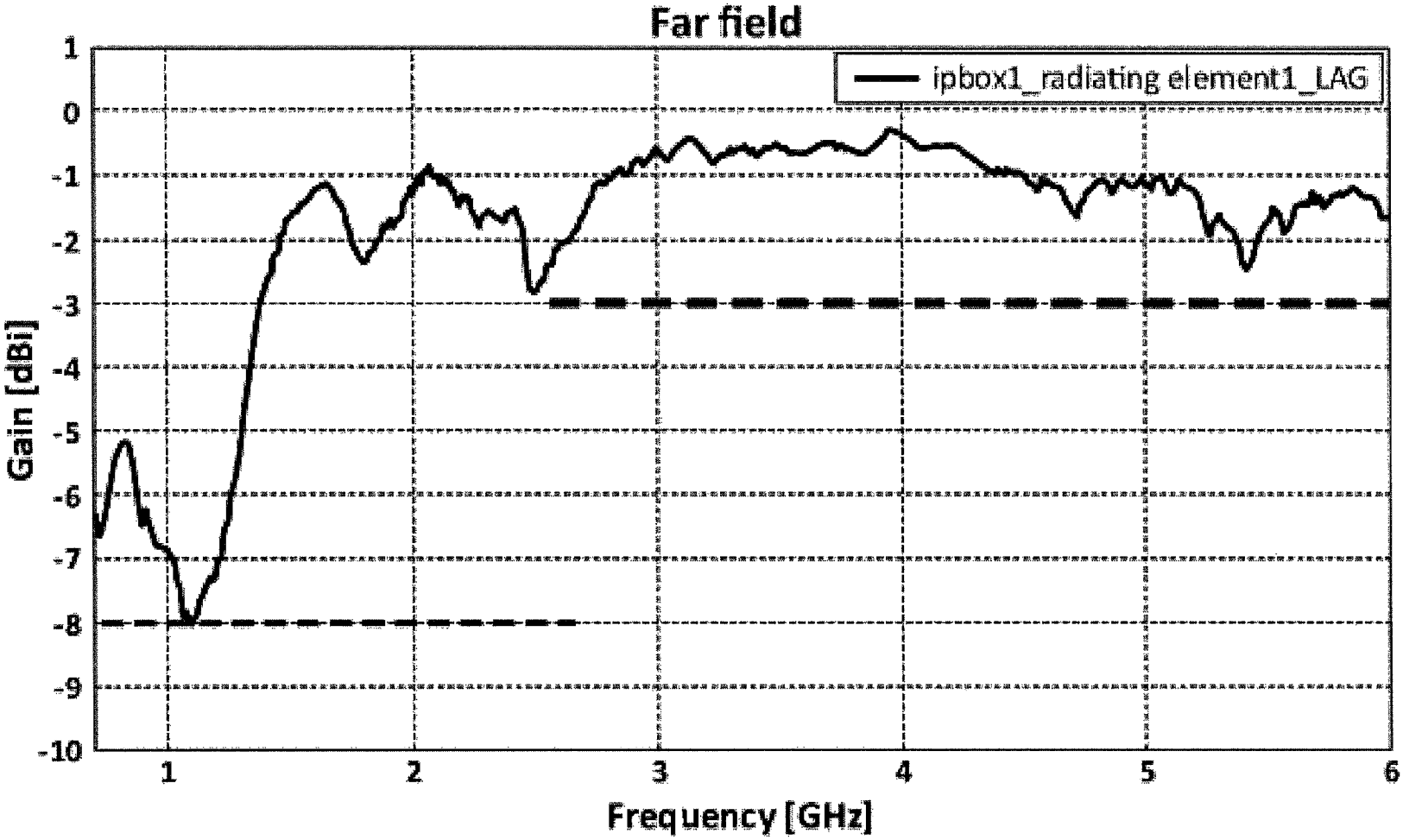
FIG. 8 shows a graph corresponding to the Total Linear Average Gain (LAG) for the first radiating element.
Figure 9:
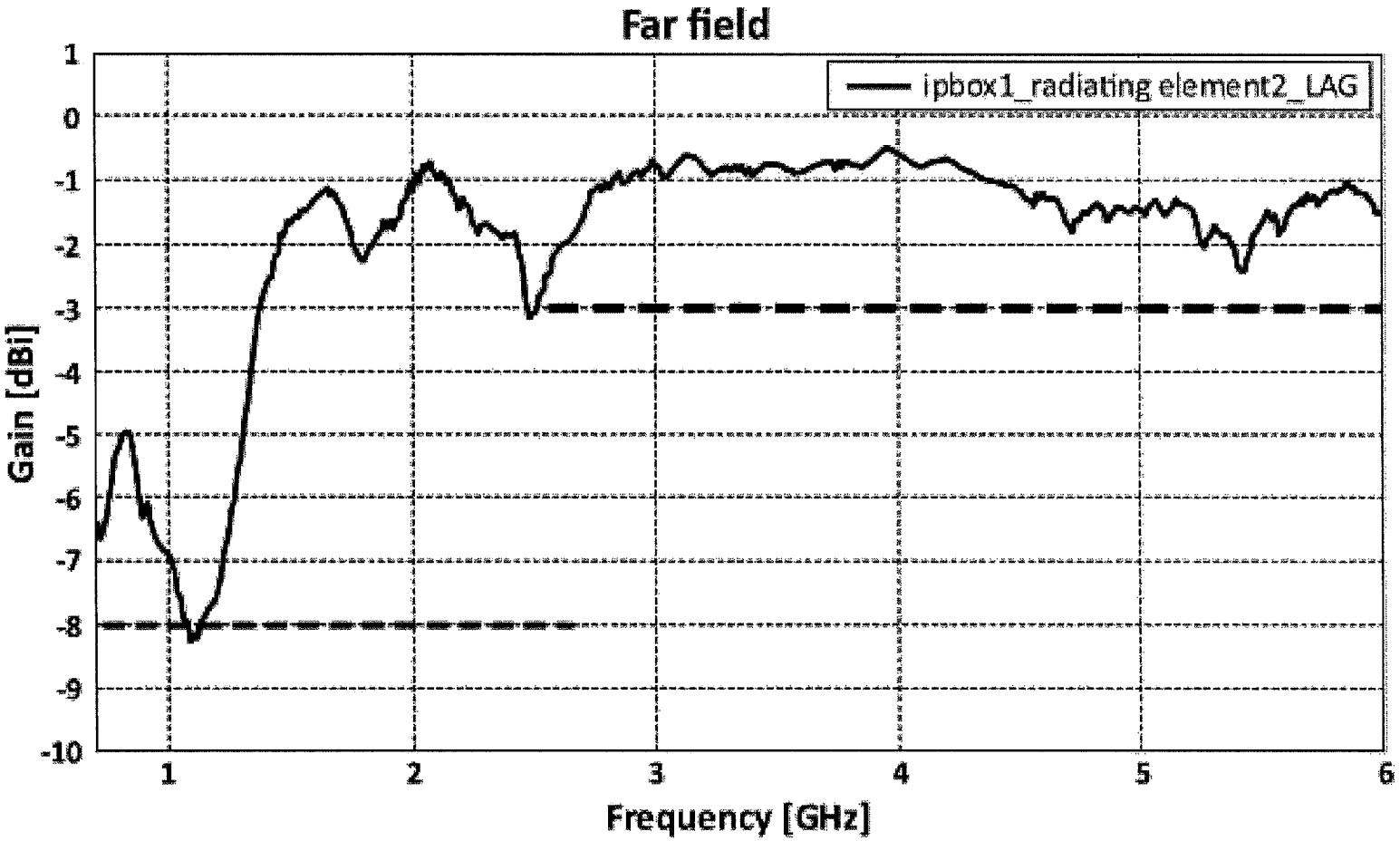
FIG. 9 shows a graph summarizing the antenna matching and the Linear Average Gain (LAG) of the two radiating elements.
Figure 11:
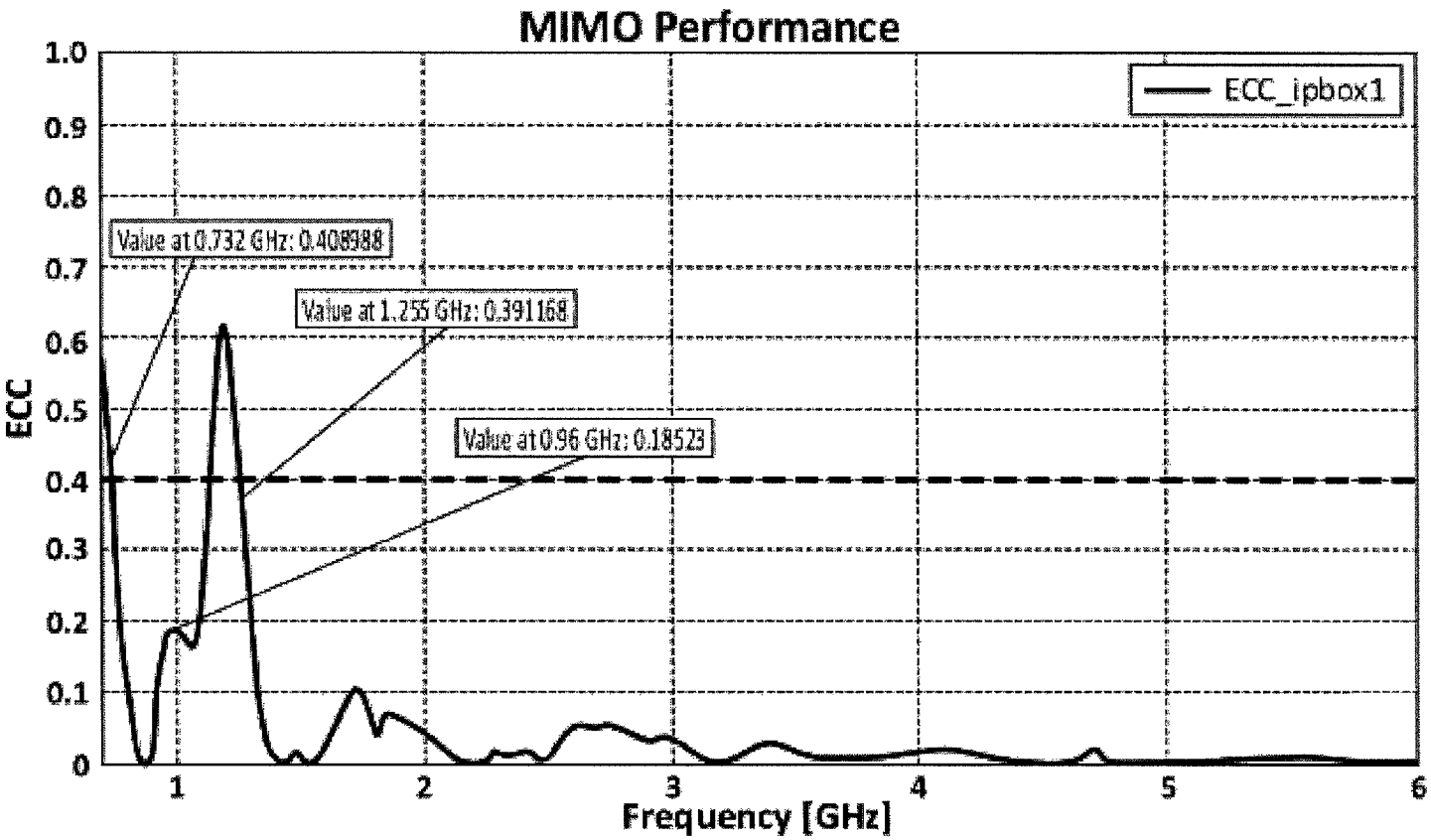
FIG. 11 shows a graph showing the MIMO performance, relative to the Envelope Cross-Correlation (ECC) of the antenna system.

In the embodiment of FIGS. 3 and 4, the first and second radiating elements 1, 2 further comprise first and second arms 6, 7 respectively extending from the vertical surfaces 1*a*, 2*a* of the radiating elements 1, 2. Each arm 6, 7 has a first segment 6*a*, 7*a* parallel to the ground plane 3, and a second segment 6*b*, 7*b* extending from the first segment 6*a*, 7*a* and parallel to the vertical surface 1*a*, 2*a* and coplanar with the vertical surface of the other radiating element 1, 2.

Alternatively, in the embodiment of FIGS. 1 and 2 each arm 6, 7 further comprises a third segment 6*c*, 7*c* extending from the second segment 6*b*, 7*b* in a direction parallel to the ground plane 3. The third segment 6*c*, 7*c* is parallel to the vertical surface 1*a*, 2*a* and coplanar with the vertical surface of the other radiating element.

The segments 6*a-c*, 7*a-*) are flat surfaces and preferably rectangular.

As shown in FIG. 4, the minimum distance d1 between the ground plane 3 and the arms 6, 7 is λ/80. With lambda considered as the previous calculation described.

Preferably, the shape of the vertical surfaces 1*a*, 2*a* of the radiating elements 1, 2 comprises a part of an ellipse curve. Similarly, the shape of the horizontal surfaces 1*b*, 2*b* of the radiating elements 1, 2 comprises a part of an elliptical curve. More specifically, the perimeter or the contour of these surfaces 1*a*,2*a*,1*b*,2*b* is configured as an elliptical curve. Alternatively, the above-mentioned surfaces could be configured as parabolic curves.

One technical effect of having the vertical surfaces 1*a*, 2*a* of the radiating elements 1, 2 shaped as an elliptical curve features a broadband behavior, ranging from 700 MHz to several GHz at 5G frequencies.

As indicated in FIG. 2, for the vertical surfaces 1*a*, 2*a* and for the horizontal surfaces 1*b*, 2*b*, preferably the semi-major (a,x) axis of the ellipse, which define the geometry, must be around 40-60% larger than semi-minor (b,y) axis.

For the vertical surfaces 1*a*, 2*a*, the portion of the semi-major axis (a) of the ellipse must be around ±20% larger than its semi-minor axis (b), and for horizontal surfaces 1*b*, 2*b*, the portion of the semi-minor axis (y) of the ellipse must be around 40-60% shorter than its semi-major axis (x)

The horizontal surfaces 1*b*, 2*b* close to the folded arm, controls the intermediate frequency bands (around 2 GHz). The horizontal surfaces 1*b*, 2*b* are also conformed by an elliptical curvature, in order to achieve a broad band operational behavior, since the intermediate frequency bands are broader than the narrower lower band.

The radiating elements 1, 2 are configured such the feeding ports 4, 5 are respectively connected between the ground plane 3 and the apex of the elliptical vertical surfaces 1*a*, 2*a*. The horizontal surfaces 1*b*, 2*b* are placed relative to the vertical surfaces, such the apexes 9,10 of the horizontal surfaces 1*b*, 2*b* are free ends.

As it can be appreciated in FIGS. 1 to 4, the shape and dimensions of the two radiating elements 1, 2 are the same, and they are arranged in an inverted relative position with respect to each other.

In the embodiment of FIG. 3 the antenna system 8 additionally comprises a decoupling conductive surface 11 connected at one of its edges with the ground plane 3 and placed orthogonally with respect to the ground plane 3 and between the first and second radiating elements 1, 2. This decoupling conductive surface 11 enhances isolation between first and second radiating elements 1, 2, and contributes to achieve a suitable matching for the lower band.

Also, in order to enhance isolation between radiating elements, the distance (d2) between the radiating elements 1, 2, as shown in FIG. 3, should be around λ/30 or more. Using the decoupling conductive surface 11 the distance could be reduced to λ/40. Also, in this figure, it can be appreciated that a preferred electric length (L1) (see arrow in FIG. 3) for the folded arms 6, 7 of that embodiment, is around λ/10.

A preferred distance (d3) between the closest points between each horizontal surface 1*b*, 2*b* and each respective folded arm 6, 7, is around λ/80 as shown in FIG. 3, although this distance (d3) could be reduced to 0 for frequency adjustment.

The folded arm 6, 7 structure is designed to control the fine tuning of the lower frequency band (around 700 MHz). Its electrical length (L1) is directly related with the operational frequency, and it can be increased in length in order to fine tune the lower band. If the arm length is extended, it must be folded to have a third segment 6*c*, 7*c*, in order to respect said minimum distance of around λ/80 over the ground plane.

In the embodiment of FIG. 4, the antenna system 8 additionally comprises a satellite navigation patch antenna (GNSS) 12 attached to the lower surface of the ground plane 3. For this, the ground plane 3 can be implemented as a Printed Circuit Board (PCB) that includes GNSS circuitry like: an amplifier, filter, couplers, a GNSS splitter (to provide two outputs), etc., without affecting the antenna performance.

The effect of having the GNSS antenna 12 in the opposite face of the ground plane 3 to the location of the radiating elements 1, 2, is that the ground plane 3 isolates the GNSS antenna from the radiating elements 1, 2.

For applications in which the antenna housing can be made larger, a GNSS multiband or multi constellation stacked patch can be provided to cover several frequency bands.

In this implementation including a GNSS antenna, the antenna system 8 can be fitted inside a housing of maximum dimensions: 85×35×30 mm.

The antenna system 8 is designed to operate at least within one Long Term Evolution (LTE) frequency band, wherein the lowest frequency of operation is 700 Mhz. Additionally, the antenna system is further adapted to provide 5G communication services.

While the above disclosure has been described with reference to exemplary embodiments, it will be understood by those skilled in the art that various changes may be made, and equivalents may be substituted for elements thereof without departing from its scope. In addition, many modifications may be made to adapt a particular situation or material to the teachings of the disclosure without departing from the essential scope thereof. Therefore, it is intended that the present disclosure not be limited to the particular embodiments disclosed but will include all embodiments falling within the scope thereof.

What is claimed is:

1. A dual broadband antenna system for vehicles, the dual broadband antenna system comprising:

first and second radiating elements and a substantially flat ground plane in common for the two radiating elements, wherein the first and second radiating elements are placed above an upper surface of the ground plane, and wherein each of the first and second radiating elements is folded and has a vertical and horizontal surface, wherein the vertical surfaces of the first and second radiating elements are substantially orthogonal to the ground plane and parallel to each other, wherein the horizontal surfaces of the first and second radiating elements are substantially coplanar between them, and substantially parallel to the ground plane; and two feeding ports respectively connected between the first and second radiating elements and the ground plane, wherein the shape of the horizontal surface of the first and second radiating elements comprises a part of an ellipse curve.

2. A dual broadband antenna system for vehicles, the duel broadband antenna system comprising:

first and second radiating elements and a substantially flat ground plane in common for the two radiating elements, wherein the first and second radiating elements are placed above an upper surface of the ground plane, and wherein each of the first and second radiating elements is folded and has a vertical and horizontal surface, wherein the vertical surfaces of the first and second radiating elements are substantially orthogonal to the ground plane and parallel to each other, wherein the horizontal surfaces of the first and second radiating elements are substantially coplanar between them, and substantially parallel to the ground plane; and two feeding ports respectively connected between the first and second radiating elements and the ground plane, wherein the first and second radiating elements further comprise first and second arms respectively extending from the vertical surface, each arm having a first horizontal segment substantially parallel to the ground plane, and wherein each arm further comprises a second segment and a third segment extending from the second segment in a direction parallel to the ground plane, and wherein the third segment is parallel to the vertical surface and coplanar with the vertical surface of the other radiating element.

3. A dual broadband antenna system for vehicles, the dual broadband antenna system comprising:

first and second radiating elements and a substantially flat ground plane in common for the two radiating elements, wherein the first and second radiating elements are placed above an upper surface of the ground plane, and wherein each of the first and second radiating elements is folded and has a vertical and horizontal surface, wherein the vertical surfaces of the first and second radiating elements are substantially orthogonal to the ground plane and parallel to each other, wherein the horizontal surfaces of the first and second radiating elements are substantially coplanar between them, and substantially parallel to the ground plane;

two feeding ports respectively connected between the first and second radiating elements and the ground plane; and a global navigation satellite system (GNSS) antenna attached to the lower surface of the ground plane.

4. A dual broadband antenna system for vehicles, the dual broadband antenna system comprising:

first and second radiating elements and a substantially flat ground plane in common for the two radiating elements, wherein the first and second radiating elements are placed above an upper surface of the ground plane, and wherein each of the first and second radiating elements is folded and has a vertical and horizontal surface, wherein the vertical surfaces of the first and second radiating elements are substantially orthogonal to the ground plane and parallel to each other, wherein the horizontal surfaces of the first and second radiating elements are substantially coplanar between them, and substantially parallel to the ground plane; and two feeding ports respectively connected between the first and second radiating elements and the ground plane, wherein the shape of the vertical surface of the first and second radiating elements comprises a part of an ellipse curve, and wherein the shape of the horizontal surface of the first and second radiating elements comprises a part of an ellipse curve.

5. The antenna system according to claim 1, wherein the first and second radiating elements further comprise first and second arms respectively extending from the vertical surface, each arm having a first horizontal segment substantially parallel to the ground plane.

6. The antenna system according to claim 2, further comprising a decoupling conductive surface orthogonally arranged and connected with the ground plane and placed between the first and second radiating elements.

7. The antenna system according to claim 3, wherein the antenna system fits inside a rectangular prismatic volume which larger side is around $\lambda/5$ long, wherein $\lambda$ is the operative wavelength and the larger side is the largest side.

8. The dual broadband antenna system according to claim 3, further comprising a decoupling conductive surface orthogonally arranged and connected with the ground plane and placed between the first and second radiating elements.

* * * * *